US011761687B2

(12) United States Patent
Unton

(10) Patent No.: US 11,761,687 B2
(45) Date of Patent: Sep. 19, 2023

(54) REFRIGERATION OR TWO PHASE PUMP LOOP COOLING SYSTEM

(71) Applicant: Rolls-Royce North American Technologies Inc., Indianapolis, IN (US)

(72) Inventor: Timothy Unton, Avon, IN (US)

(73) Assignee: ROLLS-ROYCE NORTH AMERICAN TECHNOLOGIES INC., Indianapolis, IN (US)

( * ) Notice: Subject to any disclaimer, the term of this patent is extended or adjusted under 35 U.S.C. 154(b) by 359 days.

(21) Appl. No.: 16/952,809

(22) Filed: Nov. 19, 2020

(65) Prior Publication Data

US 2022/0154980 A1 May 19, 2022

(51) Int. Cl.
*F25B 25/00* (2006.01)
*F25B 13/00* (2006.01)

(52) U.S. Cl.
CPC ..... *F25B 25/005* (2013.01); *F25B 13/00* (2013.01); *F25B 2339/047* (2013.01); *F25B 2400/0403* (2013.01); *F25B 2600/2507* (2013.01); *F25B 2600/2513* (2013.01)

(58) Field of Classification Search
CPC .. F25B 25/005; F25B 13/00; F25B 2339/047; F25B 2400/0403; F25B 2600/2501; F25B 2600/2507; F25B 2600/2513; F25B 2600/2517; F25B 41/20; F25B 41/22; F25B 41/24; F25B 41/26; F25B 41/28; F25B 41/31; F25B 41/32; F25B 41/325; F25B 41/33; F25B 41/335; F25B 41/34; F25B 41/345; F25B 41/347; F25B 41/35; F25B 41/355; F25B 41/36
See application file for complete search history.

(56) References Cited

U.S. PATENT DOCUMENTS

| | | | | |
|---|---|---|---|---|
| 5,360,139 | A * | 11/1994 | Goode | F17C 5/007 222/64 |
| 5,465,583 | A * | 11/1995 | Goode | F17C 13/123 141/4 |
| 7,360,372 | B2 | 4/2008 | Takechi et al. | |
| 7,610,766 | B2 * | 11/2009 | Dube | F25B 41/00 62/81 |
| 9,822,995 | B2 | 11/2017 | Wakamoto et al. | |
| 10,415,861 | B2 | 9/2019 | Takenaka et al. | |
| 11,268,739 | B2 * | 3/2022 | Wang | F25B 39/04 |
| 2020/0355412 | A1 * | 11/2020 | Wang | F25B 41/24 |
| 2021/0392815 | A1 * | 12/2021 | Verhoef | A01D 45/021 |

FOREIGN PATENT DOCUMENTS

| | | | |
|---|---|---|---|
| EP | 2 889 559 | B1 | 5/2018 |
| JP | 2010156502 | A | 7/2010 |
| JP | 6351848 | B2 | 7/2018 |
| WO | WO 2010/061624 | A1 | 6/2010 |

* cited by examiner

*Primary Examiner* — Miguel A Diaz

(74) *Attorney, Agent, or Firm* — Crowell & Moring LLP

(57) ABSTRACT

A cooling system comprising a cooling circuit connecting a heat exchanger and a heat load. The cooling system comprising a first velocity fuse upstream of the heat exchanger or heat load and a second velocity fuse or valve downstream of the heat exchanger or heat load. The heat exchanger or heat load is dynamically isolated from the rest of the cooling system by the first velocity fuse or the second velocity fuse in response to a velocity of a flow of cooling fluid exceeding a respective velocity setting of the first velocity fuse or the second velocity fuse.

19 Claims, 10 Drawing Sheets

REFRIGERATION OR TWO PHASE PUMP LOOP COOLING SYSTEM

TECHNICAL FIELD

This disclosure relates to cooling systems and, in particular, to refrigeration and/or cooling loops.

BACKGROUND

Present cooling systems suffer from a variety of drawbacks, limitations, and disadvantages. Accordingly, there is a need for inventive systems, methods, components, and apparatuses described herein.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Figure 1:
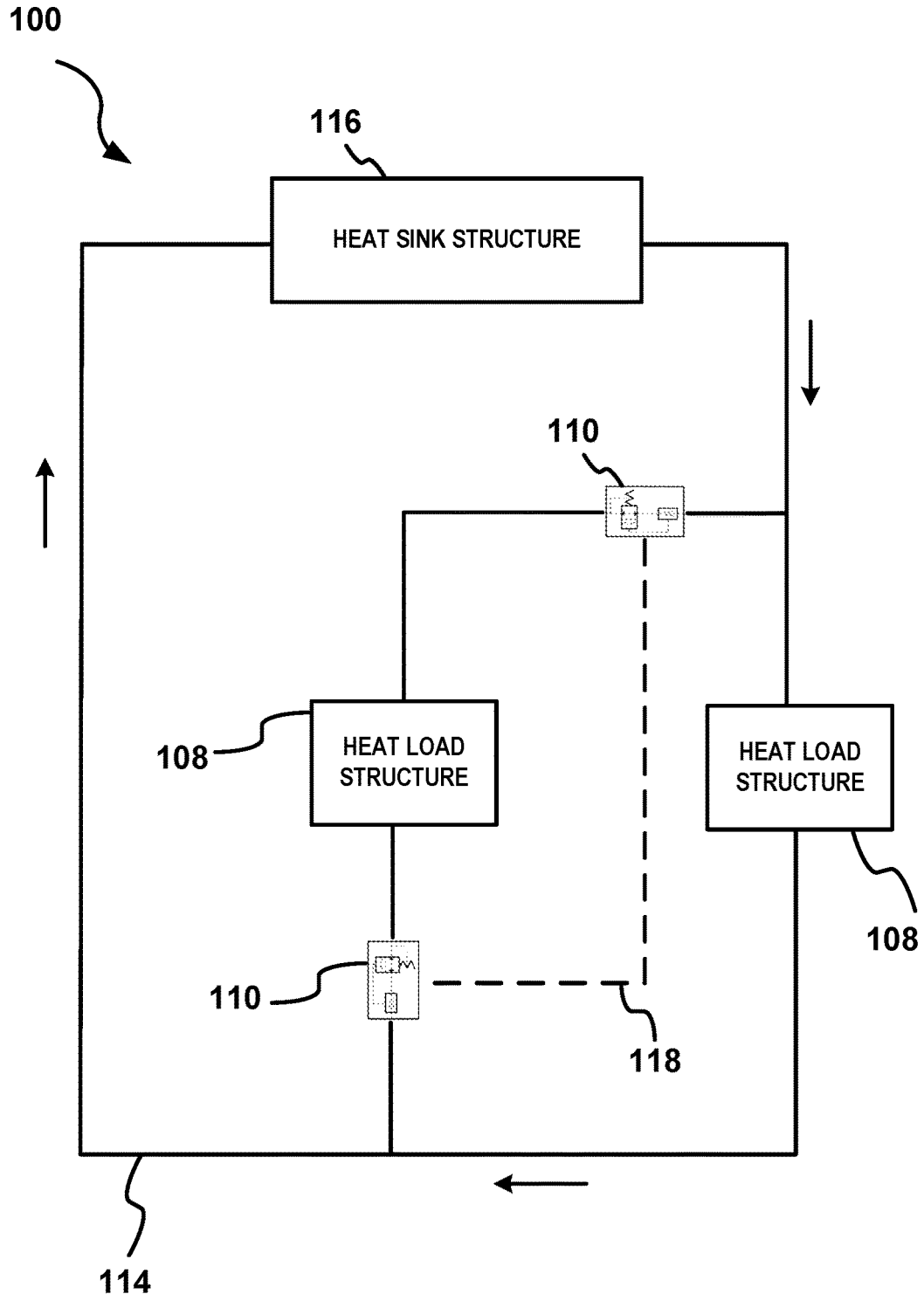
FIG. 1 illustrates an example of a cooling system.

System and methods of operation of a cooling system are described herein. The cooling system may be referred to as a two-phase pump loop (TPPL) and/or a vapor cycle system (VCS). The cooling system may be able to function as both a TPPL and/or a VCS simultaneously. The term "upstream" and "downstream" refer to the direction of flow of the cooling fluid during expected operation of the cooling system and the relative position of devices with respect to the flow direction. During expected operation, the cooling fluid may flow through the heat load structure and absorb heat from the heat load structure. The cooling fluid may then flow from the heat load structure to the heat sink structure, the cooling fluid carrying the absorbed heat from the heat load structure to the heat sink structure, and rejecting the absorbed heat to the heat sink structure.

The cooling system may comprise a heat exchanger system, which may include one or more condensers and/or gas coolers. The cooling system may comprise a cooling circuit that connects a heat load to the heat exchanger system via the cooling circuit. The heat load may be any device that is cooled by the cooling system by transferring heat to the cooling fluid flowing through the cooling circuit. The cooling system may comprise multiple heat loads. The cooling system may comprise a first velocity fuse disposed in the cooling circuit upstream of the heat load. The cooling system may comprise a second velocity fuse or a valve disposed in the cooling circuit downstream of the heat load.

The heat load may be dynamically isolated from the rest of the cooling circuit by the first velocity fuse and the second velocity fuse or by the first velocity fuse and the valve in response to a velocity of the cooling fluid to or from the heat load exceeding a respective velocity setting of the first velocity fuse or the second velocity fuse.

An example of a method for cooling a heat load may include cooling the cooling fluid flowing through a cooling circuit with the heat exchanger system and supplying the flow of the cooling fluid to the heat load with the heat exchanger system via the cooling circuit. The method may include diverting at least a portion of the flow of the cooling fluid through an orifice of a first velocity fuse disposed in the cooling circuit upstream of the heat load. A velocity of the flow of the cooling fluid may create a pressure drop across the orifice. The method may include providing a second velocity fuse or a valve disposed in the cooling circuit downstream of the heat load. The valve may be, for example, a check valve or shutoff valve. The velocity of the flow of the cooling fluid through the heat load may create a pressure drop across an orifice of the second velocity fuse. The method may include dynamically actuating at least one of the first velocity fuse or the second velocity fuse to interrupt the flow of the cooling fluid to the heat load via the cooling circuit if a velocity of the cooling fluid exceeds a respective cooling fluid velocity setting of the first velocity fuse or the second velocity fuse.

Another example of the cooling system may include a heat exchanger. The cooling system may comprise a cooling circuit connecting the heat load to the heat exchanger, the flow of cooling fluid channeled to flow through the heat load by the cooling circuit. The cooling system may comprise a first velocity fuse disposed in the cooling circuit upstream of the heat exchanger and a second velocity fuse or a check valve or shutoff valve disposed in the cooling circuit downstream of the heat exchanger and upstream of the heat load. The heat exchanger may be dynamically isolated from the rest of the cooling circuit by the first velocity fuse and the second velocity fuse or by the first velocity fuse and the check valve and/or the shutoff valve in response to a velocity of the flow of cooling fluid to or from the heat exchanger exceeding a respective velocity setting of the first velocity fuse or the second velocity fuse.

An interesting feature of the systems and methods described below may be that if a break occurs in the cooling system, for example a break at the heat load or heat exchanger, or a break somewhere along the cooling circuit, the velocity fuses and/or valves upstream and downstream of the break may automatically interrupt the flow of cooling fluid and isolate the section of the cooling circuit that contains the break. For example, the heat load and/or heat exchanger may each include multiple passages, for example, hundreds or thousands of individual passages. Due to these multiple passages, from a probabilistic standpoint, the heat load and/or heat exchanger may be the areas or components of the cooling system most likely to break. The heat exchangers may also be disposed in a location that is open or subject to the ambient environment and therefore subject to environment factors which may cause the heat exchanger to break, for example, due to impact from a bird or foreign object debris, or from a corrosion.

A break may be a breach of containment or failure of the cooling system that would cause a loss of the cooling fluid from the cooling system. The break may be an abrupt loss of the cooling fluid from the cooling system or an abrupt pressure drop in the cooling system. This prevents failure of the entire cooling system by containing the loss of pressure and/or the loss of cooling fluid to one area of the cooling circuit, isolating the area containing the break, and preventing the loss of additional cooling fluid from the cooling system.

Another interesting feature of the system and methods described below is that the velocity fuses operate substantially instantaneously and automatically. In systems where the system's normal operating pressure exceeds the ambient pressure, for example, a typical vapor cycle systems using common refrigerants where the operating pressure is typically orders of magnitude greater than ambient, because the cooling fluid in the cooling system will flow from areas of high pressure to areas of low pressure, when a break occurs and creates a low pressure area, the cooling fluid will automatically flow towards the break at a velocity higher than an expected range of operating velocity. The velocity fuses operate based on a predetermined velocity setting of the velocity fuse, which correlate to the expected operating velocity of the cooling system. As soon as cooling fluid flows through the velocity fuse at a velocity higher than the velocity setting of the velocity fuse, the velocity fuse will substantially instantaneously and automatically actuate, closing off the flow of cooling fluid through the velocity fuse towards the low pressure area of the cooling system that is created where the break occurs. Additionally or alternatively, at least a portion of the increase in velocity of the cooling fluid may be due to the cooling fluid changing phase from a liquid to a gas as it flows toward the break. The velocity fuse does not rely on external controls or signals in order to actuate and prevent a flow of cooling fluid from flowing towards the break.

FIG. 1 illustrates an example of a cooling system 100. The cooling system 100 may include one or more heat load structures 108, one or more velocity fuses 110, a cooling circuit 114, and a heat sink structure 116. The cooling system 100 may, for example, be a cooling system of an aircraft, wherein the cooling system 100 cools multiple heat load structures 108 of the aircraft. The cooling system 100 may, for example, include additional components such as valves, orifices, heat exchangers, or other similar components.

The cooling circuit 118 may connect all of the components in the cooling system 100. The cooling circuit 118, for example, may comprise pipes or tubing that connect each component, for example, the heat sink structure 116, the heat load structure 108, the velocity fuses 110, and any other components in the cooling system 100. The cooling fluid may flow through the cooling circuit from one component to another, for example, from the heat sink structure 116, through a velocity fuse 110 to the heat load structures 108, and through another velocity fuse 110 back to the heat sink structure 116.

The heat sink structure 116 may be upstream of the heat load structures 108. The heat load structures 108 may be arranged in parallel downstream of the heat sink structure 116. The velocity fuses 110 may be disposed anywhere on the cooling circuit 114. A velocity fuse 110 may be disposed downstream of the heat sink structure 116 and upstream of the heat load structure 108. Additionally or alternatively, a velocity fuse 110 may be located downstream of the heat load structure 108. The velocity fuse 110 upstream of the heat load structure 108 may be connected to the velocity fuse 110 downstream of the heat load structure 108 via a velocity fuse connector 118. As shown in FIG. 1, there may be a heat load structure 108 that does not have a velocity fuse structure 108 upstream and/or downstream of the heat load structure 108. As shown in FIG. 1, the cooling system 100, for example, may include one or more heat load structures 108 in parallel. Alternatively or additionally, the cooling system 100 may include one or more heat load structures 108 in series (as shown in FIGS. 3-4 and 6-7).

The heat sink structure 116 may be any combination of components that absorb heat, cool the cooling fluid, and supply the cooled cooling fluid to the heat load structures 108. The heat sink structure 116 may include one or more condensers, one or more gas coolers, a pump, and/or a compressor. The heat sink structure 116 may enable the cooling system 100 to operate as a two-phase pump loop (TPPL) and/or a vapor cycle system (VCS). Additionally or alternatively, the cooling system 100 may operate as, for example, a transcritical CO2 cycle, for example when the heat sink structure 116 includes a gas cooler. Additionally or alternatively, the cooling system 100 may operate as absorption cycle or an adsorption cycle. Additionally or alternatively, the cooling fluid may change phase during the cooling cycle. Additionally or alternatively, the cooling fluid flowing through the velocity fuse 110 may be in two phases.

The heat load structures 108 may include one or more components that requires cooling. For example, the heat load structures 108 may include a battery, an evaporator, an electrical machine, a preheater, a fuel heat exchanger, a power electronic, a power electronic cold plate, a high energy laser, and/or an electromechanical actuator such as, for example, a wing flap or an aileron. The heat load structures 108 may include a heat exchanger that transfers heat from the heat load structure 108 to the cooling fluid.

During operation, cooling fluid is condensed by the heat sink structure 116. The cooling fluid flows from the heat sink structure 116 downstream to the one or more heat load structures 108. The cooling fluid may or may not pass through velocity fuses 110 disposed upstream of the heat load structures 108. The cooling fluid may flow through the heat load structures 108 and absorb heat generated by the heat load structure 108, therefore cooling the heat load structures 108. The heated cooling fluid may flow from the heat load structures 108, through velocity fuses 110, and to the heat sink structure 116. The direction of flow of the cooling fluid during expected operation is indicated by flow arrows.

Figure 2:
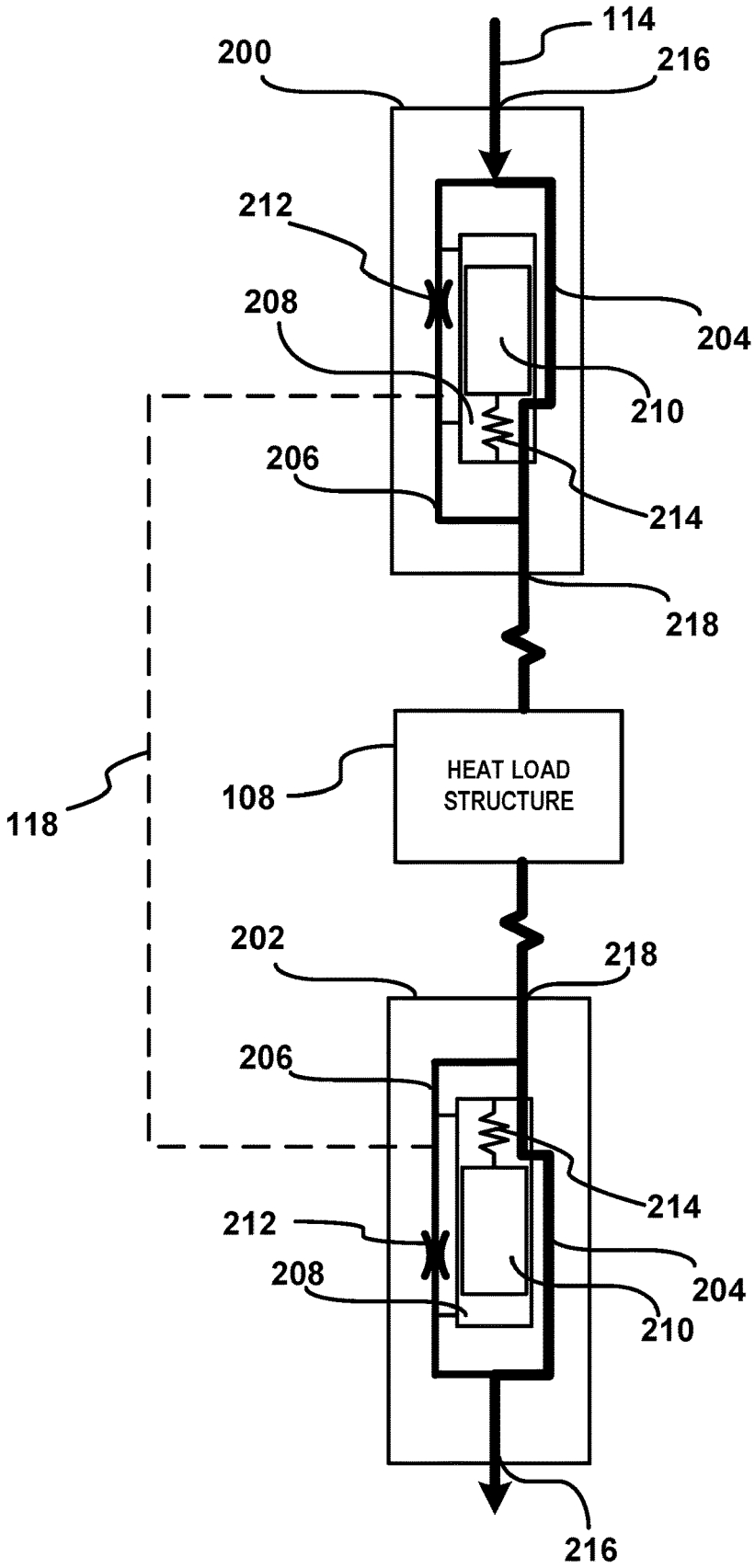
FIG. 2 illustrates an example of a velocity fuse.

FIG. 2 illustrates a more detailed view of the velocity fuses 110 shown in FIG. 1. The upstream velocity fuse 200 and the downstream velocity fuse 202 shown in FIG. 2 may be the velocity fuses 110 in the cooling system 100 as shown in FIG. 1, but the cooling system 100 may have additional or fewer velocity fuses 110.

The velocity fuses 110 may be placed upstream or upstream and downstream of the heat load structure 108 and/or of an individual heat load 412 (shown in FIGS. 4-5 and 7-8). Additionally or alternatively, the velocity fuses 110 may be placed upstream and/or downstream of an individual heat exchanger 402 (shown in FIGS. 4-5 and 7-8.) The discussion regarding the heat load structure 108 with respect to FIG. 1 applies. There may be additional components placed on the cooling circuit 114 between one of both of the velocity fuses 110 and/or between the velocity fuses 110 and the heat load structure 108.

Each one of the velocity fuses 200 and 202 may include a first opening 216, a second opening 218, a primary flow path 204, a secondary flow path 206, a cylinder chamber 208, a cylinder 210, a velocity fuse orifice 212, and a spring 214.

The cylinder 210 and/or the spring 214 may be disposed inside of the cylinder chamber 208. The spring 218 may be coupled to the cylinder 208 and to the end of the cylinder chamber 208 closer to the second opening 218 than the first opening 216. The spring 218 may provide biasing resistance and push the cylinder towards the first opening 216. The spring 218 may be any type of component that provides resistance to the cylinder 208. For example, the spring 218 may be a coil spring, a torsion spring, a piece of resistive material, or any other similar device.

The primary flow path 204 may extend through the velocity fuse 200, 202 from the first opening 216 at one end of the velocity fuse 200, 202, extend into the cylinder chamber 208 from a side of the cylinder chamber 208, extend from the cylinder chamber 208 through an end of the cylinder chamber 208, and extend from the end of the cylinder chamber 208 to the second opening 218 of the velocity fuse 200, 202. The first opening 216 may be at an end of the velocity fuse 200, 202 opposite the end of the velocity fuse 200, 202 with the second opening 218.

The secondary flow path 206 may split from the primary flow path 204 within the velocity fuse 200, 202 between the first opening 216 and the cylinder chamber 208, extend through an orifice 212, and merge with the primary flow path 204 between the cylinder chamber 208 and the second opening 218. The secondary flow path 206 and/or the orifice 208 may be connected to the cylinder chamber 208 on either side of the cylinder 210.

The velocity fuses 200, 202 may each be set to a respective predetermined velocity setting. The velocity setting of the upstream velocity fuse 200 may be the same or different than the velocity setting of the downstream velocity fuse 202. The velocity setting may correlate to a maximum allowable velocity of the cooling fluid flowing through the velocity fuse 200, 202. Additionally or alternatively, the velocity setting may correlate to the expected cooling fluid operating velocity of the component downstream of the upstream velocity fuse 200, for example, as shown in FIG. 2, the heat load structure 108. Additionally or alternatively, the velocity setting may correlate to the expected cooling fluid operating velocity of a heat load 412 or an individual heat exchanger 402 (shown in FIGS. 4-5 and 7-8). The force the spring 214 exerts on the cylinder 210 may correlate to the velocity setting.

Referring back to FIG. 1, the cooling fluid in the cooling system 100 may flow from areas of high pressure to areas of low pressure. If a break occurs somewhere in the cooling system 100, for example, in one of the components of the system and/or in the cooling circuit 114 line, the break may cause a low pressure point at the location of the break and cooling fluid may leak out of the system at the break point. The low pressure at the break point may cause an increase in the velocity of the cooling fluid flowing towards the break point. Alternatively, or additionally, the low pressure at the break point may cause the cooling fluid to flow in the reverse direction of expected operating flow.

Referring back to FIG. 2, the cooling fluid flows through the velocity fuse 200, 202, the velocity flow creates a pressure drop across the orifice 212. The pressure drop across the orifice 212 and the connections between the secondary flow path 206 and/or orifice to the cylinder chamber 208 create a pressure that acts as an applied force on the cylinder 210. The pressure pushes the cylinder 210 towards the second opening 218 and/or the side of the cylinder chamber 208 to which the spring 214 is coupled. The spring 214 is biased to push the cylinder 210 towards the first opening 216 with a resisting force that acts in a direction opposite to the pressure acting on the cylinder 210 created by the pressure drop across the orifice 212.

When the velocity of the cooling fluid through the velocity fuse 200, 202 is less than the predetermined velocity setting of the velocity fuse 200, 202, the biasing force of the spring 214 counter acts the pressure applied to the cylinder 210 due to the pressure drop. Consequently, the cylinder 210 is pushed towards the end of the cylinder chamber 208 near the first opening 216 and the primary flow path 204 thought the cylinder chamber 208 is unobstructed.

When the flow of cooling fluid through the velocity fuse 200, 202 increases the pressure drop across the orifice 212 increases, the pressure pushing the cylinder 210 towards the second opening 218 increases. When the velocity of the cooling fluid exceeds the velocity setting of the velocity fuse 200, 202, the pressure on the cylinder 210 from the pressure drop across the orifice 212 is greater than the force exerted on the cylinder 210 by the spring 214. When the velocity of the cooling fluid exceeds the velocity setting of the velocity fuse 200, 202, the cylinder 210 is pushed towards the end of the cylinder chamber 208 near the second end 218 of the velocity fuse 200, 202, and the cylinder 210 blocks the primary flow path 204 through the cylinder chamber 208, stopping the cooling fluid from flowing through the velocity fuse 200, 202.

During expected operation, the cooling fluid may flow from the heat sink structure 116 to the upstream velocity fuse 200. The cooling fluid may flow from the heat sink structure 116 to the first opening 200 of the upstream velocity fuse 200. A primary portion of the cooling fluid may flow through the primary flow path 204 of the upstream velocity fuse 200. Additionally or alternatively, a smaller portion of the cooling fluid may flow through the secondary flow path 208 of the upstream velocity fuse 200.

The cooling fluid may flow from the second opening 218 of the upstream velocity fuse 200 to the heat load structure 108. The cooling fluid may flow through the heat load structure 108, and from the heat load structure 108 to the second opening 218 of the downstream velocity fuse 202. A primary portion of the cooling fluid may flow through the primary flow path 204 of the downstream velocity fuse 202. Additionally or alternatively, a smaller portion of the cooling fluid may flow through the secondary flow path 208 of the downstream velocity fuse 202. The cooling fluid may flow from the first opening 216 of the downstream velocity fuse 202 downstream to the heat sink structure 116.

The upstream velocity fuse 200 may be oriented such that the second opening 218 of the upstream velocity fuse 200 is downstream of the first opening 216 of the upstream velocity fuse 200. The second opening 218 of the upstream velocity fuse 200 may be closer to the heat load structure 108 that is downstream of the upstream velocity fuse 200 than the first opening 216 of the upstream velocity fuse 200. The downstream velocity fuse 202 may be oriented in reverse of the upstream velocity fuse 200 such that the second opening 218 of the downstream velocity fuse 202 is upstream of the first opening 216 of the downstream velocity fuse 202. The second opening 218 of the downstream velocity fuse 202 may be closer to the heat load structure 108 that is upstream of the downstream velocity fuse 202 than the first opening 216 of the downstream velocity fuse 202.

When a break in the cooling system occurs at the heat load structure 108 (or at the individual heat exchanger 402 or heat load 412 as shown in FIGS. 4-5 and 7-8) and/or between the heat load structure 108 and one of the velocity fuses 200, 202, cooling fluid will begin to flow towards the break at an increased velocity, which may, for example, be due to a change in phase of the cooling fluid from liquid to gas as it travels towards the break. For example, cooling fluid may flow toward the break at a velocity higher than the expected operating velocity of the cooling system 100. The cooling fluid would flow from upstream of the upstream velocity fuse 200 or from downstream of the downstream velocity fuse 202 and into the first openings 216 of the respective velocity fuses 200, 202 at an increased velocity. Once this high velocity cooling fluid flows through the secondary flow path 206 and across the orifice 212, the pressure enacted on the cylinder 210 due to the pressure drop across the orifice 212 will substantially instantaneously cause the cylinder 210 to compress the spring, move towards the end of the cylinder chamber 208 near the second opening 218 of the velocity fuse, and block off the flow of the primary flow path 204 through the cylinder chamber 208. The flow of cooling fluid through the velocity fuse 200, 202 will be blocked and the cooling fluid prevented from flowing past the velocity fuse 200, 202 towards the break in the line.

Different embodiments of the cooling system 100 may have varying flow velocities depending on the level of pressure drop that can be tolerated in the cooling system. Cooling systems 100 that use a lower viscosity cooling fluid or lower density cooling fluid may be able to operate at higher expected operating velocities for an equivalent pressure drop. The expected operating flow velocity of the cooling system 100 may typically be less than 100 m/s, and may, for example, be 1 m/s or less. The change in velocity due to line breakage may depend on how large the breakage is as well as the expected operating pressure of the cooling system 100 relative to the ambient pressure. The change in velocity may be governed by the Darcy-Weisbach equation.

As an example, the expected operating flow velocity may be 11 m/s and the expected cooling system 100 operating pressure may be approximately 110 psig. Upon line breakage there may be a $\Delta p$ of 110 psi (expected operating pressure to ambient pressure). Assuming no change in phase of the cooling fluid, the corresponding increased flow velocity for this $\Delta p$ that may result from a breakage may be to −270 m/s. Changes in pressure may propagate through the cooling system 100 at the speed of sound in the particular cooling fluid used in the cooling system 100. The fluid velocity may not change at the same rate due to inertia. An expectation may be that the velocity fuse would actuate upon line breakage on the order of less than a second to seconds, as opposed to minutes or longer.

The cut off of the flow of cooling fluid through the velocity fuses 200, 202 is substantially instantaneous and is not reliant on external controls or electrical systems. Once the velocity of the cooling fluid flowing through from the first opening 216 to the second opening 218 exceeds the predetermined velocity setting of the velocity fuse 200, 202 and the spring 214, the force on the cylinder 210 resulting from the pressure drop across the orifice 212 exceeds the force on the cylinder 210 from the spring 214, and the cylinder automatically is forced towards the end of the cylinder chamber 208 near the second opening 218 of the velocity fuse 200, 202, and the flow of cooling fluid through the velocity fuse 200, 202 is stopped, preventing cooling fluid from flowing towards the break and leaking from the cooling system 100.

The upstream velocity fuse 200 and the downstream velocity fuse 202 may be connected by the velocity fuse connector 118. The velocity fuse connector 118 may be, for example, a pressure link that synchronizes operation of the fuses. The pressure link may connect the secondary flow path 206 of the upstream velocity fuse 200 to the secondary flow path 206 of the downstream velocity fuse 202 such that both secondary flow paths 208 are at the same pressure. The velocity fuse connector 118 may allow for both the upstream velocity fuse 200 and the downstream velocity fuse 202 to actuate at substantially the same time if the velocity settings of one of the velocity fuses 200, 202 has been exceeded, regardless of if the velocity of the cooling fluid through the other velocity fuse 200, 202 has exceeded the velocity setting of the respective velocity fuse 200, 202. Additionally or alternatively, the velocity fuse connector 118 between the two fuses may be mechanically or electrically coupled with an actuator The velocity fuses 200, 202 may automatically reset to the pre-actuation configuration (allowing cooling fluid to flow through the velocity fuse 200, 202) when the conditions present in the cooling system 100 return to expected operating conditions, for example, the expected operating flow velocity and/or the expected operation pressure of the cooling system 100. Additionally or alternatively the velocity fuses 200, 202 may actuate permanently and subsequently may require a manual reset or may have to be replaced.

Figure 3:
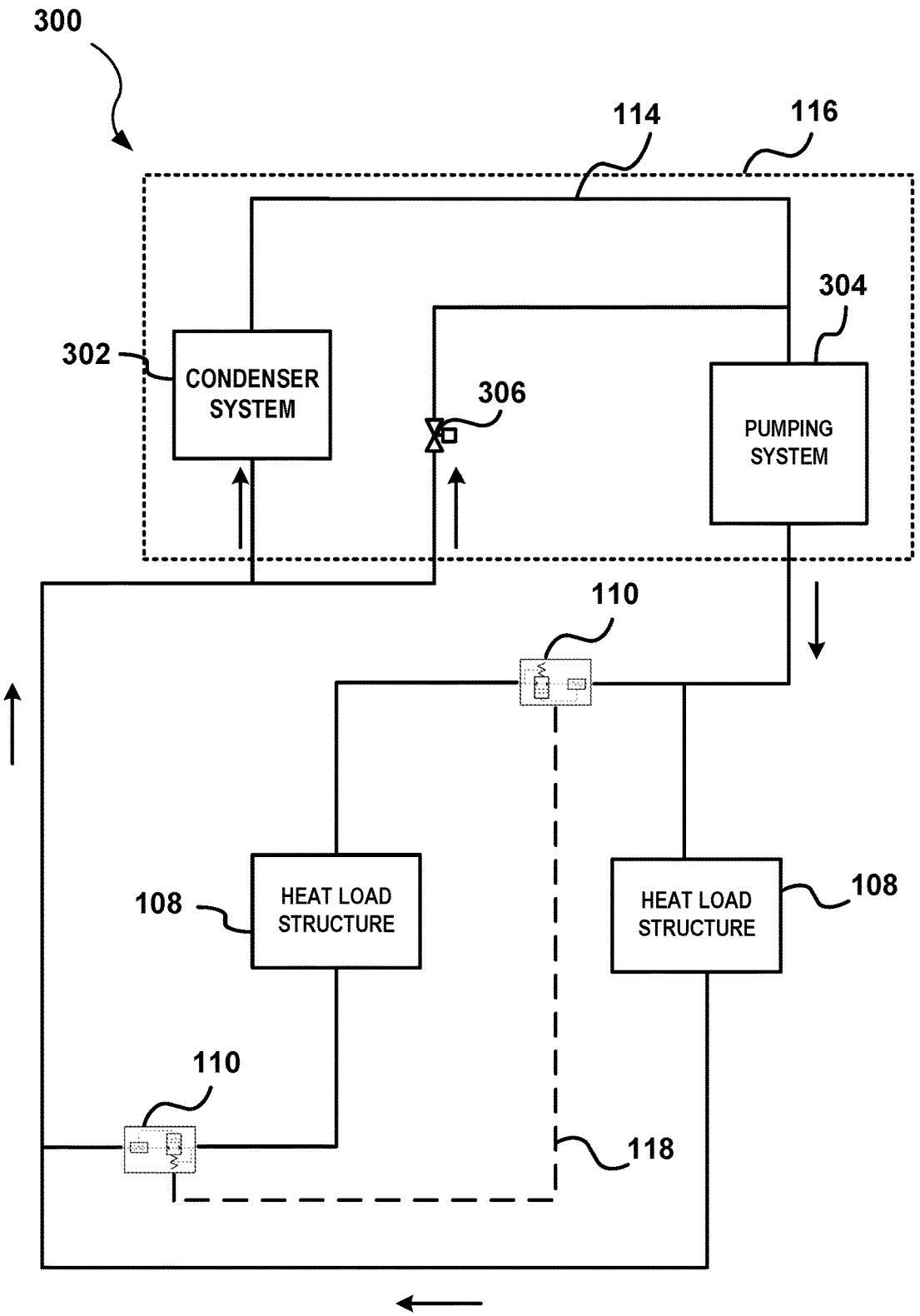
FIG. 3 illustrates another example of a cooling system.

FIG. 3 illustrates an example of cooling system 300. The cooling system 300 may represent at least a portion of the cooling system 100 shown in FIG. 1 when the cooling system 100 is, for example, operating as a two phase pump loop (TPPL). FIGS. 1-2, are applicable to the following embodiments and examples unless otherwise indicated. Accordingly, such features and functionality are interchangeable and combinable among the various examples described. The cooling system 300 may include the heat sink structure 116, the cooling circuit 114, one or more heat load structures 108, one or more velocity fuses 110, and one or more velocity fuse connector 118. The heat sink structure 116 may include a heat exchanger system 302, a pumping system 304, a flow control valve 306.

The heat exchanger system 302 may be upstream of the pumping system 304, and/or one or more of the heat load structures 108. The heat exchanger system 302 may cool a cooling fluid used to cool the heat load structures 108 via the cooling circuit 114. The pumping system 304 may be upstream of the heat load structures 108 and pump the cooling fluid cooled by the heat exchanger system 302 to the heat load structures 108.

The heat exchanger system 302 may be any combination of components that cools and/or condenses heated cooling fluid. The heat exchanger system 302 may include one or more condensers, gas coolers, and/or any other type of heat exchanger capable of cooling the cooling fluid. The heat exchanger system 302 components may be condensers, for example, air cooled or water cooled condensers. The condensers may use ambient air to cool the cooling fluid. The condensers may be exposed to ambient conditions of the cooling system 300. Additionally or alternatively, the heat exchanger system 302 components may be any type of heat exchangers that cool the cooling fluid as it flows through the condensers. The heat exchangers may use ambient air to cool the cooling fluid. The heat exchange may be any form of one or more systems, mechanisms or devices that provide transfer of heat energy between different fluids. Example heat exchangers include a plate fin heat exchanger, a tube bank heat exchanger, a plate heat exchanger, a micro/mini-channel heat exchanger, a printed circuit heat exchanger, a Marbond heat exchanger, and/or any other thermal transfer system or device.

The pumping system 106 may include any combination of components that pump cooling fluid to the heat load structures 108. The pumping system 106 may include, for example, a tank, a pump, a bypass valve, a valve, and/or an accumulator (as shown in FIGS. 3-4).

During operation, the heat exchanger system 302 may receive heated cooling fluid from the heat load structures 108, wherein the heated cooling fluid has absorbed heat from the heat load structures 108. The heat exchanger system 302 may condense and cool the cooling fluid. Cooling fluid may flow from the heat exchanger 302 and/or the control valve 306 to the pumping system 304. The pumping system 304 may pump the cooling fluid to the one or more heat load structures 108. The heat load structures 108 may transfer heat to the cooling fluid. The cooling fluid may flow from the heat load structure 108 to the heat exchanger system 302 and/or the control valve 306.

Figure 4:
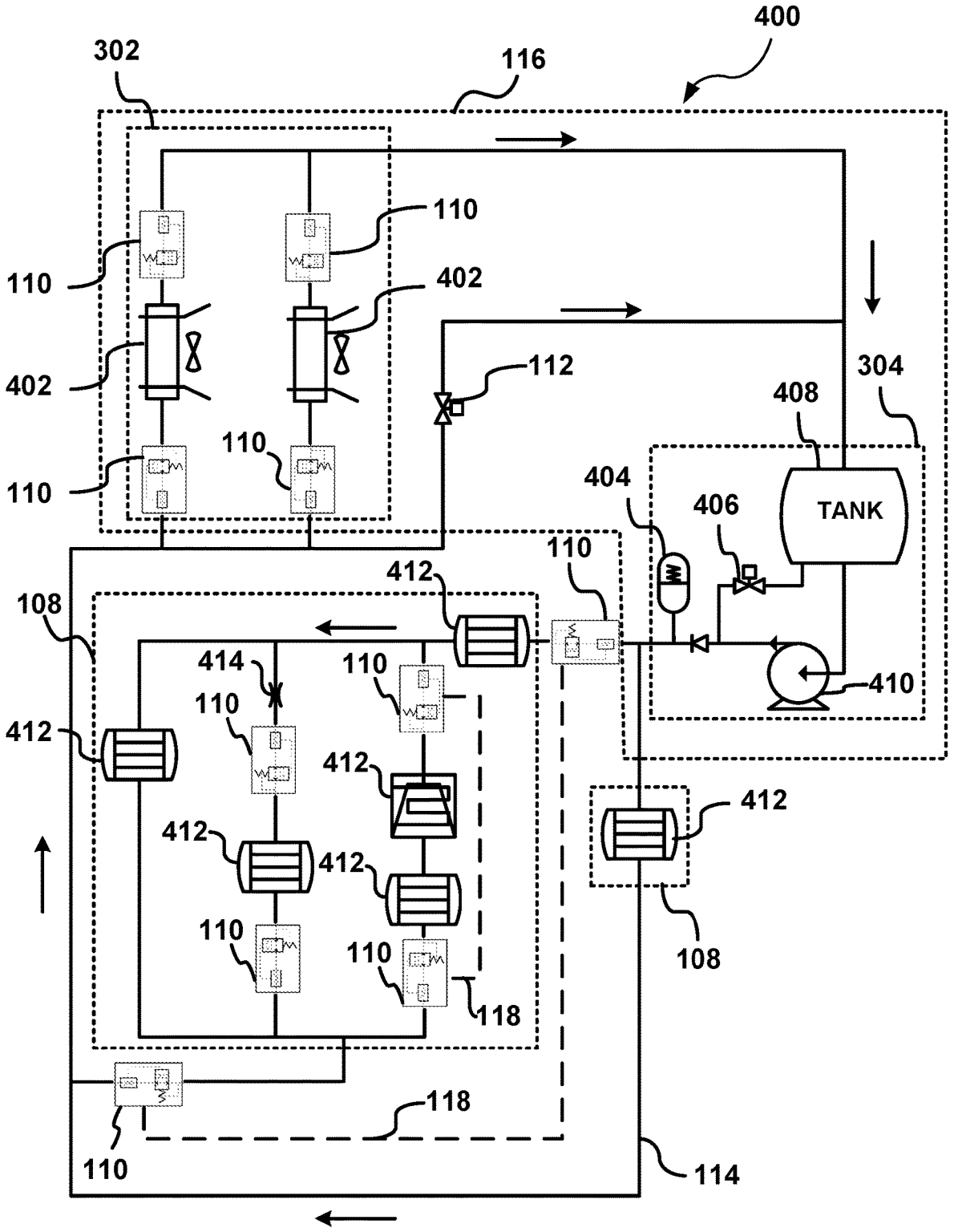
FIG. 4 illustrates another example of a cooling system.

FIG. 4 illustrates an example of a cooling system 400. The cooling system 400 may be a more detailed system than the cooling system 300 shown in FIG. 3. FIGS. 1-3, are fully applicable to the following embodiments and examples unless otherwise indicated. Accordingly, such features and functionality are interchangeable and combinable among the various examples described. The heat exchanger system 302 may include multiple individual heat exchangers 402. The pumping system 304 may include a tank 408, a bypass valve 406, a pump 410, and an accumulator 404. The heat load structures 108 may each include one or more heat loads 412 and velocity fuses 110.

The individual heat exchanger 402 may be, for example, a condenser, a gas cooler, and/or any other type of component capable of cooling the cooling fluid. The individual heat exchanger 402 may be, for example, a condenser, such as an air cooled or water cooled condenser. The condenser may use ambient air to cool the cooling fluid. The condenser may be exposed to ambient conditions of the cooling system 300. Additionally or alternatively, the individual heat exchanger 402 may be any type of heat exchangers that cool the cooling fluid as it flows through the condensers. The individual heat exchangers 402 may use ambient air to cool the cooling fluid. The individual heat exchanges 402 may be any form of one or more systems, mechanisms or devices that provide transfer of heat energy between different fluids. Example individual heat exchangers 402 include a plate fin heat exchanger, a tube bank heat exchanger, a plate heat exchanger, a micro/mini-channel heat exchanger, a printed circuit heat exchanger, a Marbond heat exchanger, and/or any other thermal transfer system or device The heat exchanger system 302 may include one or more individual heat exchangers 402 connected in parallel or series relative to each other. As shown in FIG. 4, the heat exchanger system 302 may include two parallel branches, with each branch including an individual heat exchanger 402. The heat exchanger system 302 may include more or fewer branches, and each branch may include additional individual heat exchangers 402. Each branch of the heat exchanger system 302 may include one of more velocity fuses 110. The velocity fuses may be located upstream and/or downstream of the individual heat exchangers 402 on the branch. For example, as shown in FIG. 4, each branch of the heat exchanger system 302 may include a velocity fuse 110 upstream of the individual heat exchanger 402 on the branch and downstream of the individual heat exchanger 402 on the branch. The branches my rejoin downstream of the downstream velocity fuse 110.

The pumping system 304 may include a tank coupled to cooling circuitry downstream of the heat exchanger system 302. The tank 408 may be in fluid communication with an outlet of the heat exchanger system 302. The pump 410 may be downstream of the tank 406 and in fluid communication with the tank 408. The bypass valve 406 may be downstream of the pump 410 and in fluid communication with the pump 410 and the tank 408. The accumulator 404 may be downstream of the pump 410 and upstream of the heat load structures 108.

The pump 410 may be a liquid pump or any other device capable of pumping cooling fluid from the tank 408 to the heat load structures 108. The cooling fluid may flow from the heat exchanger system 102 to the tank 408. The pump 410 may pump the cooling fluid from the tank 408 to the accumulator and/or bypass valve 406.

The bypass valve 406 may be, for example, a control valve, solenoid valve, or any valve capable for controlling a flow of the cooling fluid from the pump 410 back to the tank 408. The bypass valve 406 may be disposed on a branch of the cooling circuit 114 may split off from the length of the cooling circuit 114 connecting the pump 410 to the accumulator and return to the tank 408.

The accumulator 404 may be downstream of the pump 410. The accumulator may be any device capable of accumulating cooling fluid and releasing the cooling fluid back to the cooling circuit 114. For example, when there is turbulence in the cooling circuit 114, for example, a water hammer or an abrupt increase in pressure in the cooling circuit 114, the accumulator 404 may absorb the excess force experienced by the cooling fluid in the cooling circuit 114. The accumulator 404 may then redistribute the absorbed cooling fluid back to the cooling circuit 114 in order to supply critical cooling fluid to the heat load structures 108, for example, when there is insufficient cooling fluid being supplied by the pump 410.

The heat load structure 108 may include multiple individual heat loads 412. The heat load structure 108 may include multiple individual heat loads 412 connected in parallel. Each parallel branch of the heat load structure 108 may include one or more individual heat loads 412. Additionally or alternatively, each parallel branch of the heat load structure 108 may include a velocity fuse 110 upstream of the heat load 412 on the branch. The heat load structure 108 may include one or more orifices 414.

Each parallel branch may also include a velocity fuse 110 downstream of the heat load structure 108 on the branch. The heat load structure 108 may include a heat load 412 upstream and/or downstream of the parallel branches connected in series with the downstream heat loads 412. One or more of the velocity fuses 110 may be connected by a velocity fuse connector 118. For example, a velocity fuse upstream of the branches of the heat load structure 108 may be connected to a velocity fuse downstream of the branches of the heat load structure 108. Alternatively or additionally, a velocity fuse 110 on a branch of the heat load structure 108 and upstream of the heat load 412 on the branch may be connected to a velocity fuse 110 on the same branch downstream of the heat load 412. One or more of the branches of the heat load structure 108 may include an orifice 412 upstream of the velocity fuse 110 that is upstream of the heat load 412 on the branch.

During expected operation, cooling fluid may flow from the heat load structures 108, 412 to the heat exchanger system 302. The cooling fluid may split between the branches of the heat exchanger system 302 and flow through the velocity fuses 110 upstream of the individual heat exchangers 402, through the individual heat exchangers 402, through the velocity fuses 110 downstream of the individual heat exchanger 402, rejoin the flow of cooling fluid from the other branch, and flow to the pumping system 304. The pumping system 304 may pump the cooling fluid from the control valve 112 and/or the heat exchanger system 302 to the heat load structure 108. The cooling fluid may flow through the heat load structures 108 and absorb heat from the heat loads 412. The cooling fluid may then flow from the heat structures 108 to the heat exchanger system 302.

As described above with respect to FIG. 2, the placement of the velocity fuses 110 as shown in FIG. 4 prevent cooling fluid from leaking out of a break in the line that occurs in the heat exchanger system 302, for example, in one of the branches of the heat exchanger system 302, and/or a break in the heat load structure 108, for example, a break in one of the branches of the heat load structure 108.

If a break occurred in the heat exchanger system 302 or a branch of the heat exchanger system 302, the velocity fuses 110 would prevent cooling fluid from flowing toward the break from upstream of the break (the heat load structures 108 or from other branches of the heat exchanger system 302), or towards the break from downstream of the break (from the pumping system 304). If a break occurred in the heat load structure 108 or a branch of the heat load structure 108, the velocity fuse 110 would prevent cooling fluid from flowing toward the break from upstream of the break (the pumping system 304 or from other branches of the heat load structure 108), or towards the break from downstream of the break (for the heat exchanger system 302 or other branches of the heat load structure 108). One of the heat load structures 108, for example, may not have a velocity fuse 110 between the heat load structure 108 and the pump system 106 and/or may not have a velocity fuse 110 between the heat load structure 108 and the heat exchanger system 302.

Additionally or alternatively, a velocity fuse 110 upstream of another velocity fuse 110 may have a higher velocity setting than the downstream velocity fuse. For example, a velocity fuse 110 upstream of multiple branches of the heat load structure 108 or the heat exchanger system 302 may have a higher velocity setting that a velocity fuse on an individual branch of the heat load structure 108 or heat exchanger system 302. If a relatively smaller leak occurs, it may cause the velocity fuse 110 in the individual branch to actuate, without affecting the velocity fuse 110 upstream of multiple branches. However, if a relatively large break occurs, the velocity fuse upstream of multiple branches may actuate, consequently closing off cooling fluid from those multiple branches.

Figure 5:
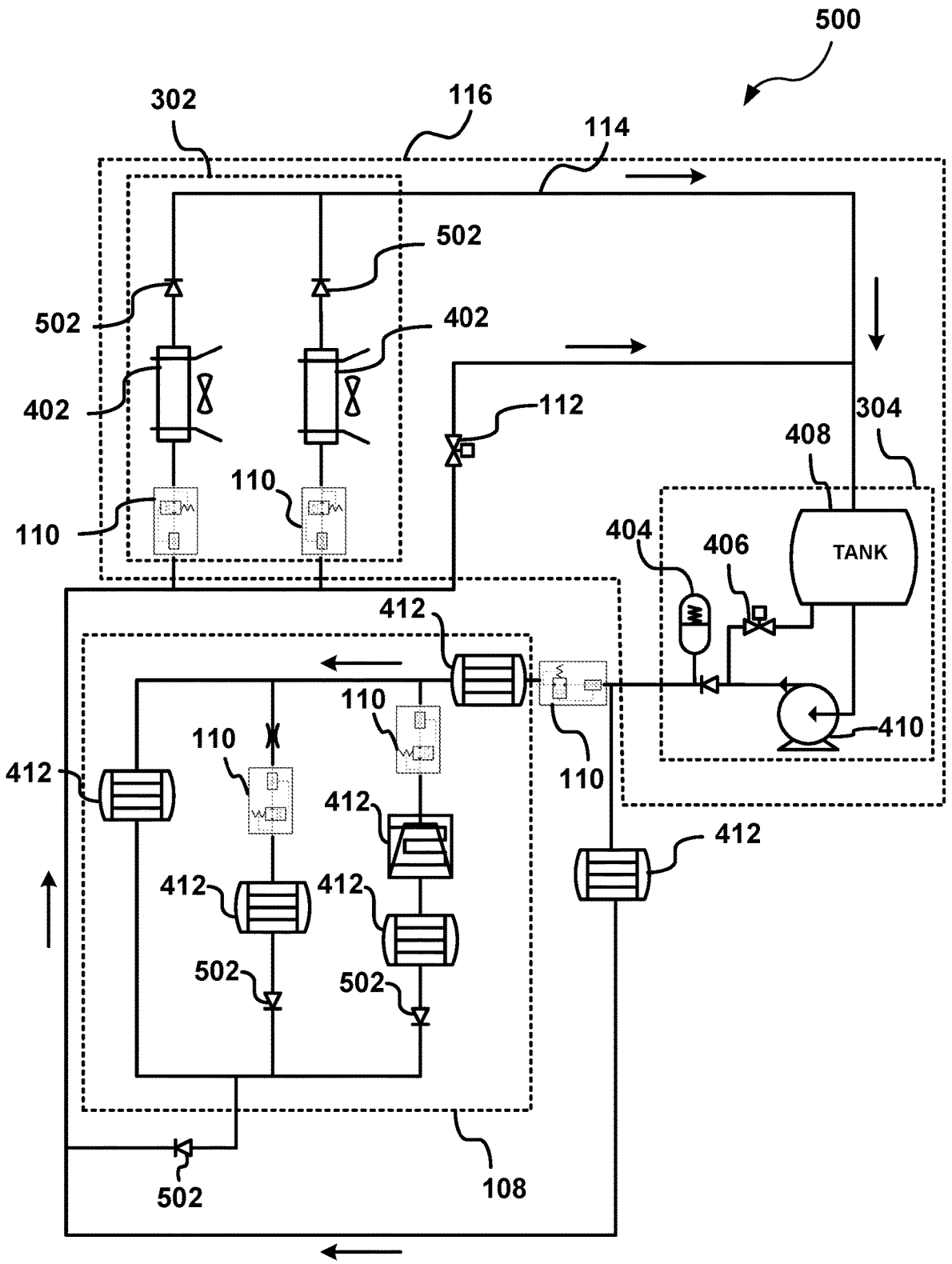
FIG. 5 illustrates another example of a cooling system.

FIG. 5 illustrates another example of cooling system 500. The cooling system 500 may be a more detailed system than the cooling system 300 shown in FIG. 3. FIGS. 1-4, are fully applicable to the following embodiments and examples unless otherwise indicated. Accordingly, such features and functionality are interchangeable and combinable among the various examples described. The cooling system 500 is similar to the cooling system 400 shown in FIG. 4 except that the individual heat loads 412 and the individual heat exchangers 402 have valves 502 downstream of them instead of velocity fuses 110. The valves 502 may be any type of valve that only allows a flow of fluid in one direction—in this case, for example, a flow of the cooling fluid from the individual heat exchanger 402 towards the pumping system 304. For example, the valve 502 may be a check valve or a shutoff valve. For example, the valve 502 may be a mechanical check valve, for example, a valve comprising a flap that will close upon flow reversal and that will consequently stop the flow of fluid though the valve, or the valve 502 may be any other type of check valve the prohibits fluid from flowing in a certain direction. Additionally or alternatively, the valve 502 may be a shutoff valve that may be actuated by the velocity fuse 110. The downstream valve may sit in two-phase flow, and a shutoff valve may be lightweight as compared to a second velocity fuse 110 or check valve.

In the event of a break in the heat exchanger system 302, for example, in one of the branches of the heat exchanger system 302 at one of the individual heat exchangers 402 or between the velocity fuse 110 and the valve 502, the valve 502 on the respective branch will prevent the flow of cooling fluid from reversing and flowing toward the individual heat exchanger 402 from the pumping system 304. In the event of a break in the heat load structure 108, for example, in one of the branches of the heat load structure 108 at one of the individual heat loads 412 or between the velocity fuse 110 and the valve 502 upstream and downstream of the heat load structure 108 and/or of an individual heat load 412, the valve 502 downstream of the heat load 412 on a respective branch of downstream of the heat load structure 108 will prevent the flow of cooling fluid from reversing and flowing toward the heat load structure 108 or heat load 412 from the heat exchanger system 302.

Figure 6:
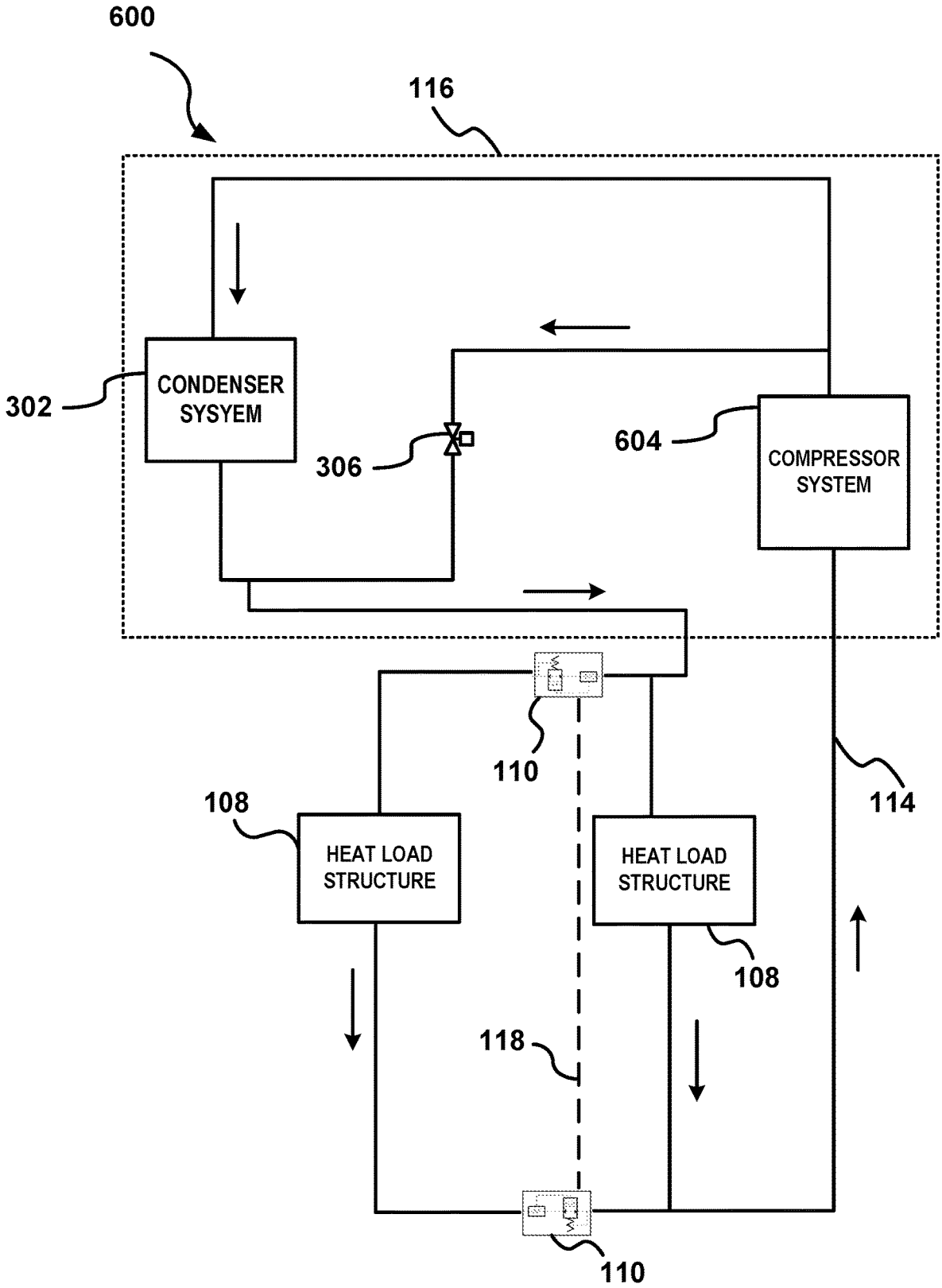
FIG. 6 illustrates another example of a cooling system.

FIG. 6 illustrates a cooling system 600. The cooling system 600 may represent at least a part of the cooling system 100 shown in FIG. 1 when the cooling system 100 is, for example, operating as a vapor cycle system (VCS). FIGS. 1-5, are fully applicable to the following embodiments and examples unless otherwise indicated. Accordingly, such features and functionality are interchangeable and combinable among the various examples described. The cooling system 100 may include both the cooling system 300 and the cooling system 600, for example, if the cooling system 100 is acting as a TPPL with a VCS assist. The cooling system 600 includes the heat sink structure 116, the cooling circuit 114, one or more heat load structures 108, one or more velocity fuses 110, and/or the velocity fuse connector. The heat sink structure 116 may include a heat exchanger system 302, the control valve 306, the compressor system 604.

The control valve 306 may be downstream of the compressor system 604 and upstream of the heat load structures 108. The compressor system 604 may be upstream of the heat exchanger system 302 and downstream of the heat load structures 108. The heat exchanger system 302 may be upstream of the heat load structures 108 and downstream of the compressor system 604. The compressor system 604 may be any combination of components that compresses the cooling fluid. The compressor system 104 may, for example, include a compressor.

During operation, cooling fluid may flow from the heat load structures 108 to the compressor system 604. The compressor system 104 may compress the cooling fluid. The compressor system 104 may output the compressed cooling fluid to the heat exchanger system 302 and/or the control valve 306. The compressor system 604 and/or the control valve 306 may supply cooling fluid to the heat exchanger system 302 via the cooling circuit 114.

Figure 7:
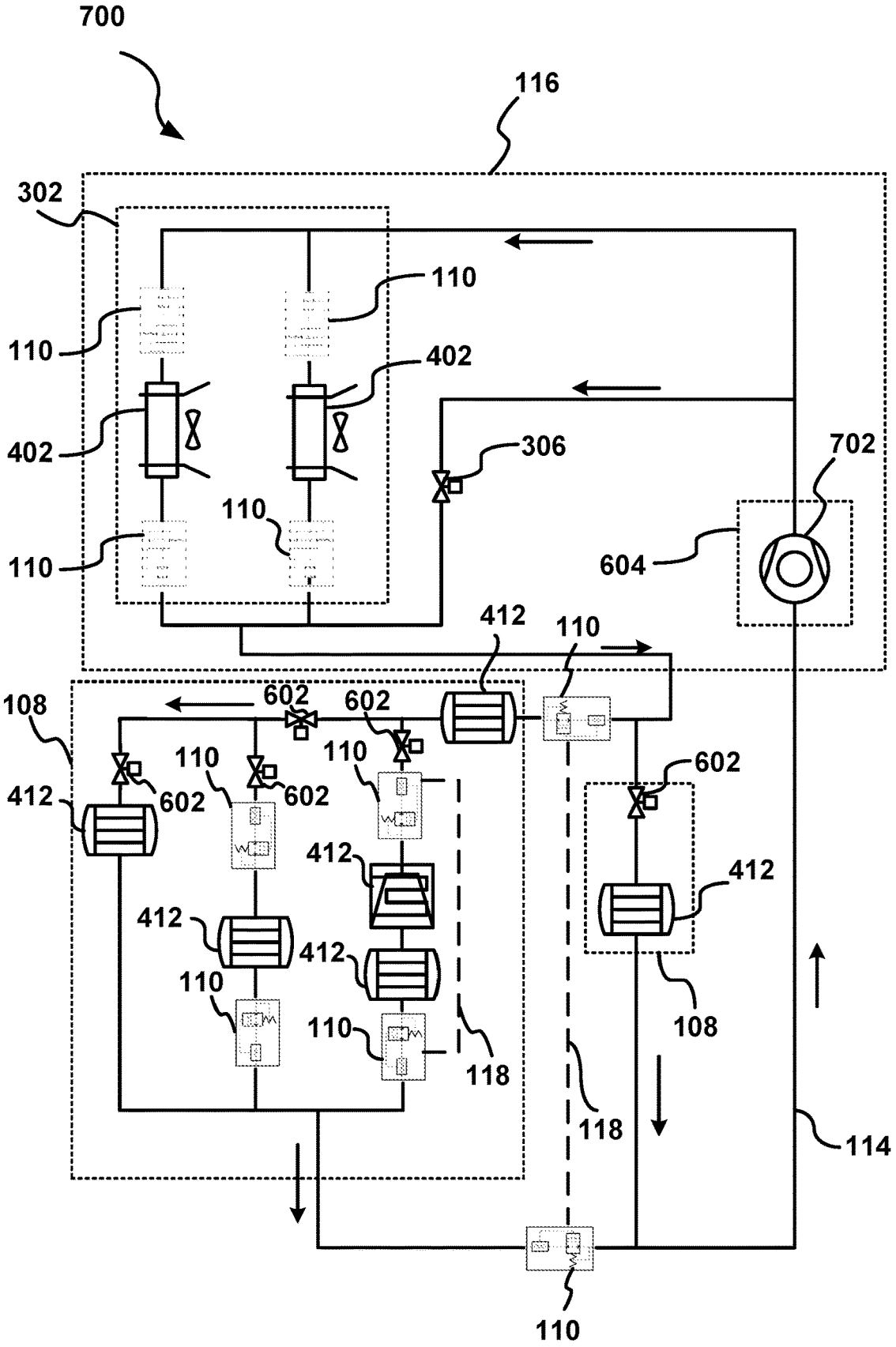
FIG. 7 illustrates another example of a cooling system.

FIG. 7 illustrates a more detailed version of a system having some of the features of the cooling system 600 shown in FIG. 6. FIGS. 1-6, are fully applicable to the following embodiments and examples unless otherwise indicated. Accordingly, such features and functionality are interchangeable and combinable among the various examples described. The compressor system 604 may include a compressor 702 The heat load structures 108 may include expansion valves 602 upstream of the heat loads 412, for example, each branch of the heat load structure 108 may include an expansion valve 602 upstream of the heat load 412 or upstream of the velocity fuse 110 that is upstream of the heat load 412 on a respective branch. Additionally or alternatively, an expansion valve 602 may be upstream of multiple branches of the heat load structure 108. Additionally or alternatively, there can be an expansion valve 602 and an orifice 110 upstream of the heat load 412 on a respective branch or upstream of multiple branches.

During operation, the cooling fluid may flow from the heat load structures to the compressor 702. The compressor 702 may compress the cooling fluid and supply the cooling fluid to the heat exchanger system 302 and/or the control valve 306. The heat exchanger system 302 may cool the cooling fluid. The cooled cooling fluid may flow from the heat exchanger system 302 and/or the control valve 306 to the heat load structures 108.

During a break in the cooling system 700, the placement of the velocity fuses 110 as shown in FIG. 7 prevent cooling fluid from leaking out of a break in the line that occurs in the heat exchanger system 302, for example, in one of the branches of the heat exchanger system 302, and/or a break in the heat load structure 108, for example, a break in one of the branches of the heat load structure 108. For example, if a break occurred in the heat exchanger system 302 or a branch of the heat exchanger system 302, the velocity fuses 110 would prevent a flow of cooling fluid toward the break from upstream of the break (from the heat load structures 108 or other branches of the heat exchanger system 302), or toward the break from downstream of the break (from the compressor system 702 of other branches of the heat exchanger system 302). If a break occurred in the heat load structure 108 or a branch of the heat load structure 108, the velocity fuse 110 would prevent cooling fluid from flowing toward the break from upstream of the break (the heat exchanger system 302 or from other branches of the heat load structure 108), or toward the break from downstream of the break (from the compressor system 604 or other branches of the heat load structure 108.)

Figure 8:
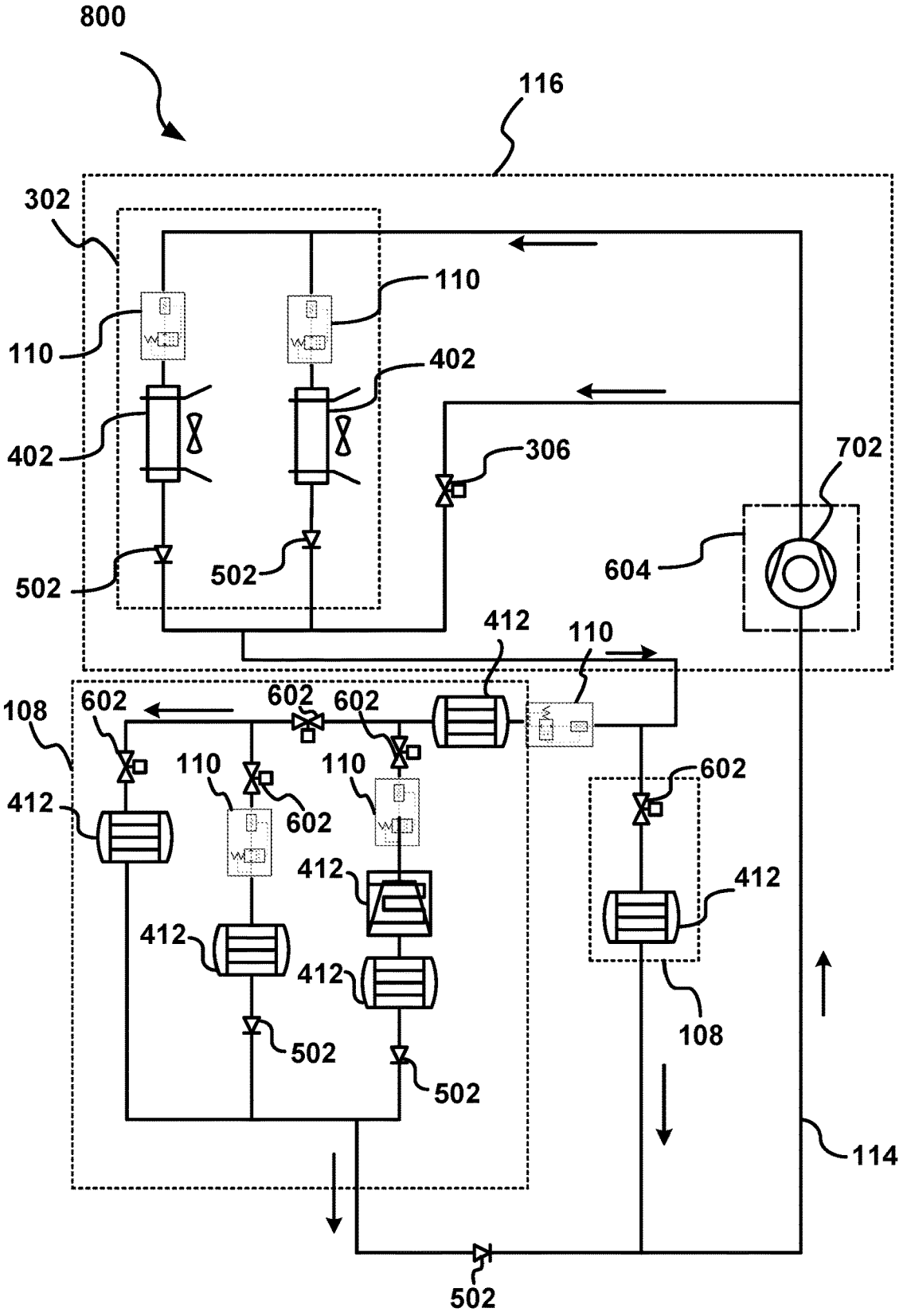
FIG. 8 illustrates another example of a cooling system.

FIG. 8 illustrates another more detailed version of a system having some of the features of the cooling system 600 shown in FIG. 6. FIGS. 1-7, are fully applicable to the following embodiments and examples unless otherwise indicated. Accordingly, such features and functionality are interchangeable and combinable among the various examples described. The cooling system 800 is similar in at least some respects to the cooling system 700 shown in FIG. 7. In FIG. 8, the individual heat loads 412 and the individual heat exchangers 402 have valves 502 downstream of them instead of velocity fuses 110 as illustrated in FIG. 7. The valves 502 may be, for example, a check valve or a shutoff valve. The valve 502, for example may be any type of valve that only allows a flow of fluid in one direction—in this case, for example, a flow of the cooling fluid from the individual heat exchanger 402 towards the heat load structures 108. For example, the valve 502 may be a check valve, for example, a mechanical valve comprising a flap that will close upon flow reversal and that will consequently stop the flow of fluid though the valve. Additionally or alternatively, the valve 502 may be a shutoff valve that may be actuated by the velocity fuse 110.

In the event of a break in the heat exchanger system 302, for example, in one of the branches of the heat exchanger system 302 at one of the individual heat exchangers 402 or between the velocity fuse 110 and the valve 502, the valve 502 on the respective branch will prevent the flow of cooling fluid from reversing and flowing toward the individual heat exchanger 402 from the heat load structure 108. In the event of a break in the heat load structure 108, for example, in one of the branches of the heat load structure 108 at one of the individual heat loads 412 or between the velocity fuse 110 and the valve 502 upstream and downstream of the heat load structure 108 and/or of an individual heat load 412, the valve 502 downstream of the heat load 412 on a respective branch of downstream of the heat load structure 108 will prevent the flow of cooling fluid from reversing and flowing toward the heat load structure 108 or heat load 412 from compressor system 604.

Figure 9:
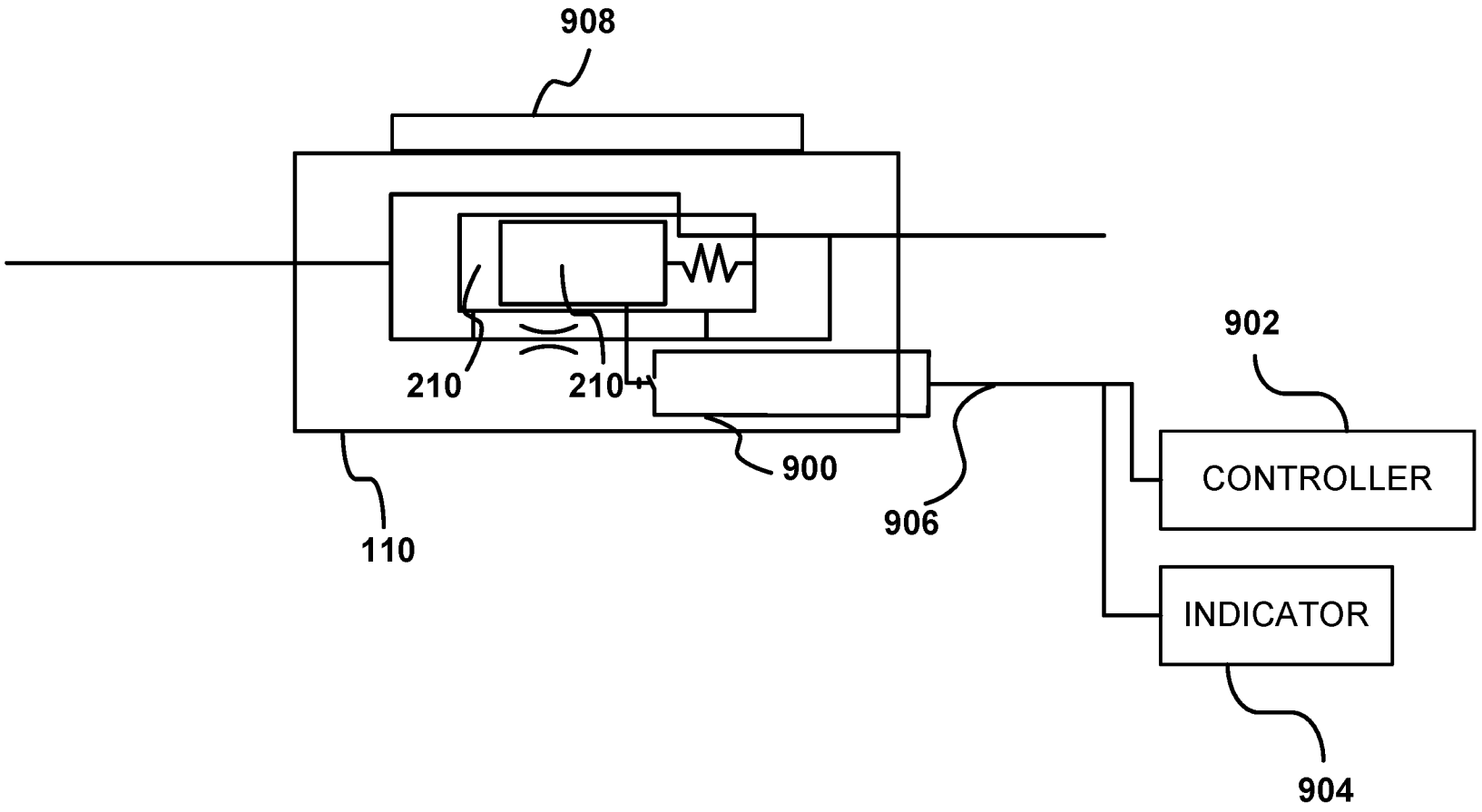
FIG. 9 illustrates another example of a velocity fuse.
Figure 10:
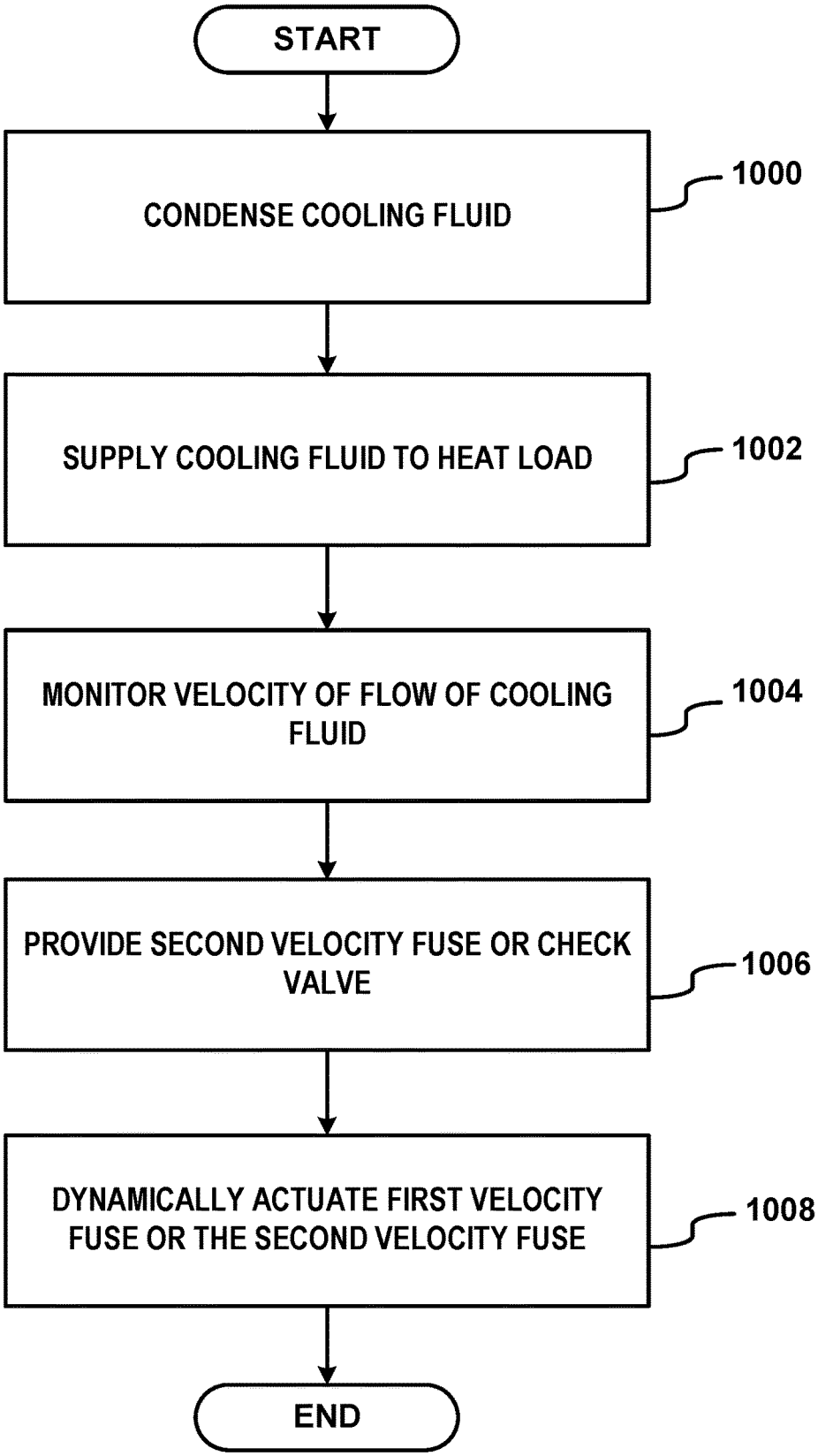
FIG. 10 illustrates a flow diagram of an example operation of a cooling system.

FIG. 9 illustrates another example of a velocity fuse 110. The velocity fuse 110 may include a physical indicator 908 and/or electrical contacts 900. The electrical contacts 900 may connect the velocity fuse 110 to an electrical circuit 906. The electrical circuit 906 may be in communication with a controller 902 and/or an electrical indicator 904.

The electrical indicator 904 may be, for example, a light on a control panel, an alert on a display screen, or any device that would alert an operator of the actuation of the velocity fuse 110 and that a component of the cooling system is no longer receiving cooling fluid. The controller 902 may take the input on the actuated velocity fuse 110 and initiate a response action, for example, shutting down the component no longer receiving cooling fluid. When the velocity fuse 110 is actuated and the cylinder 210 closes off the flow of cooling fluid through the velocity fuse 110, the actuation may close the electrical circuit, triggering the electrical indicator.

The physical indicator 908 may be any mechanical device that indicates the actuation of the velocity fuse 110 to an operator, such as by physically looking at the velocity fuse 110. For example, the physical indicator 908 may be a clear panel so the operator can see into the cylinder chamber 210 and see if the cylinder 208 has blocked the flow of the cooling fluid through the velocity fuse 110.

FIG. 9 illustrates a flow diagram of an example of operational steps to cool a heat load. Operations may begin, for example, by condensing (1002) cooling fluid by the heat exchanger system 302. The cooling fluid may be supplied (1004) to a heat load 412 from the heat exchanger system 302 via a cooling circuit 114. A velocity of the cooling fluid may be monitored (1004) by a first velocity fuse 110 that is disposed in the cooling circuit 114 upstream of the heat load 412. A second velocity fuse 110 or a valve 502 may be provided (1006) in the cooling circuit 114 downstream of the heat load 412. The second velocity fuse 110 may monitor the velocity of the flow of cooling fluid through the heat load 412. The first velocity fuse 110 or the second velocity fuse 110 may be dynamically actuated (1008) to interrupt the flow of cooling fluid to the heat load 412 is the velocity of the cooling fluid exceeds a respective cooling fluid velocity of the first velocity fuse 110 or the second velocity fuse 110. The steps may include additional, different, or fewer operations than illustrated in FIG. 9. The steps may be executed in a different order than illustrated in FIG. 9.

Each component may include additional, different, or fewer components. The heat load structure 108 may include fewer, additional, or different types of heat loads 412 or control valves and/or orifices. The heat exchanger system 302 may include fewer, additional, or different types of heat exchangers, heat sinks, and/or control valves.

The system 100 may be implemented with additional, different, or fewer components. For example, the cooling systems 100, 300, 400, 500, 600, 700, 800 may include additional or fewer components such as valves and/or regulators to control a flow of the cooling fluid. Additionally or alternatively, the system 100, 300, 400, 500, 600, 700, 800 may include a controller, a memory, and/or a processor.

The logic illustrated in the flow diagrams may include additional, different, or fewer operations than illustrated. The operations illustrated may be performed in an order different than illustrated.

To clarify the use of and to hereby provide notice to the public, the phrases "at least one of <A>, <B>, . . . and <N>"

or "at least one of <A>, <B>, . . . <N>, or combinations thereof" or "<A>, <B>, . . . and/or <N>" or "at least one of <A>, <B>, . . . or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

A first aspect relates to a cooling system comprising: a heat exchanger; a cooling circuit connecting a heat load to the heat exchanger, a flow of cooling fluid channeled to flow through the heat load by the cooling circuit; a first velocity fuse disposed in the cooling circuit upstream of the heat load; and a second velocity fuse or a valve disposed in the cooling circuit downstream of the heat load, wherein the heat load is dynamically isolated from the cooling circuit by the first velocity fuse and the second velocity fuse or by the first velocity fuse and the valve in response to a velocity of the flow of cooling fluid to or from the heat load exceeding a respective velocity setting of the first velocity fuse or the second velocity fuse.

A second aspect relates to the cooling system of aspect 1, wherein the valve is a first valve, the cooling system further comprising a third velocity fuse upstream of the heat exchanger and a fourth velocity fuse or a second valve downstream of the heat exchanger.

A third aspect relates to the cooling system of any preceding aspect, wherein the heat exchanger is a first heat exchanger, the cooling system further comprising a second heat exchanger, wherein the first heat exchanger and the second heat exchanger are in parallel, and wherein a fifth velocity fuse is upstream of the second heat exchanger and a sixth velocity fuse or a third valve is downstream of the second heat exchanger.

A fourth aspect relates to the cooling system of any preceding aspect, wherein the fourth velocity fuse or the second valve interrupts a reverse flow of cooling fluid, wherein the reverse flow of cooling fluid flows upstream to the heat exchanger from the heat load.

A fifth aspect relates to the cooling system of any preceding aspect, wherein the first velocity fuse is connected to the second velocity fuse via a velocity fuse connector, wherein the velocity fuse connector actuates the second velocity fuse in response to actuation of the first velocity fuse or the velocity fuse connector actuates the first velocity fuse in response to actuation of the second velocity fuse.

A sixth aspect relates to the cooling system of any preceding aspect, wherein the heat load is a first heat load, the cooling system further comprising a second heat load in parallel with the first heat load, wherein a third velocity fuse is upstream of the second heat load and a fourth velocity fuse is downstream of the second heat load.

A seventh aspect relates to the cooling system of any preceding aspect, wherein the heat load is a first heat load, the cooling system further comprising a second heat load in series with the first heat load, wherein the first velocity fuse is upstream of the first heat load and the second velocity fuse or the valve is downstream of the second heat load.

An eight aspect relates to the cooling system of any preceding aspect, further comprising an accumulator upstream of the heat load and the first velocity fuse, wherein the accumulator absorbs an increase in pressure in the cooling system from actuation of at least one of the first velocity fuse or the second velocity fuse.

A ninth aspect relates to the cooling system of any preceding aspect, wherein a fifth velocity fuse is upstream of the first heat load, the second heat load, the first velocity fuse, and the third velocity fuse.

A tenth aspect relates to the cooling system of any preceding aspect, wherein the a velocity setting of the fifth velocity fuse is higher than the velocity setting of the first velocity fuse and a velocity setting of the third velocity fuse.

An eleventh aspect relates to the cooling system of any preceding aspect, wherein the velocity setting of the first velocity fuse is higher than a velocity setting of a third velocity fuse, wherein the third velocity fuse is positioned downstream of the first velocity fuse.

A twelfth aspect relates to the cooling system of any preceding aspect, wherein the first velocity fuse is electrically connected to a controller or indicator via an electrical circuit, wherein actuation of the first velocity fuse generates an actuation signal with the electrical circuit.

A thirteenth aspect relates to a method for cooling a heat load, the method comprising cooling a cooling fluid via a heat exchanger system; supplying a flow of the cooling fluid to a heat load with the heat exchanger system via a cooling circuit; diverting at least a portion of the flow of the cooling fluid through an orifice of a first velocity fuse disposed in the cooling circuit upstream of the heat load, a velocity of the flow of the cooling fluid creating a pressure drop across the orifice; providing a second velocity fuse or a valve disposed in the cooling circuit downstream of the heat load, the velocity of the flow of the cooling fluid through the heat load creating a pressure drop across an orifice of the second velocity fuse; and dynamically actuating at least one of the first velocity fuse or the second velocity fuse to interrupt the flow of the cooling fluid through the heat load via the cooling circuit if a velocity of the cooling fluid exceeds a respective cooling fluid velocity setting of the first velocity fuse or the second velocity fuse, or both the first velocity fuse and the second velocity fuse.

A fourteenth aspect relates to the method of aspect 13, the method further comprising triggering the second velocity fuse to interrupt the flow of the cooling fluid upon actuation of the first velocity fuse or triggering the first velocity fuse to interrupt the flow of the cooling fluid upon actuation of the second velocity fuse.

A fifteenth aspect relates to the method of any preceding aspect, further comprising closing the valve when the flow of the cooling fluid through the valve reverses direction and flows upstream towards the heat load.

A sixteenth aspect to the method of any preceding aspect, further comprising triggering an indicator when the first velocity fuse or the second velocity fuse actuates, the indicator alerting an operator to the actuation of the first velocity fuse or the second velocity fuse.

A seventeenth aspect relates to method of any preceding aspect, further comprising closing a valve or turning off the heat load in response to at least one of the first velocity fuse or the second velocity fuse interrupting the flow of the cooling fluid.

An eighteenth aspect relates to a cooling system comprising: a heat exchanger; a cooling circuit connecting a heat load to the heat exchanger, a flow of cooling fluid channeled to flow through the heat load by the cooling circuit; a first velocity fuse disposed in the cooling circuit upstream of the heat exchanger; and a second velocity fuse or a valve disposed in the cooling circuit downstream of the heat exchanger and upstream of the heat load; wherein the heat exchanger is dynamically isolated from the cooling circuit by the first velocity fuse and the second velocity fuse or by the first velocity fuse and the valve in response to a velocity of the flow of cooling fluid to or from the heat exchanger exceeding a respective velocity setting of the first velocity fuse or the second velocity fuse.

A nineteenth aspect relates to the cooling system of aspect 18, wherein the orientation of the second velocity fuse in the cooling circuit is the reverse of the orientation of the first velocity fuse in the cooling circuit.

A twentieth aspect relates to the cooling system of any preceding aspect, wherein the second velocity fuse or the valve interrupts a reverse flow of cooling fluid toward the heat exchanger from the heat load.

In addition to the features mentioned in each of the independent aspects enumerated above, some examples may show, alone or in combination, the optional features mentioned in the dependent aspects and/or as disclosed in the description above and shown in the figures.

What is claimed is:

1. A method for cooling a heat load, the method comprising cooling a cooling fluid via a heat exchanger system;

supplying a flow of the cooling fluid to a heat load with the heat exchanger system via a cooling circuit;

diverting at least a portion of the flow of the cooling fluid through an orifice of a first velocity fuse disposed in the cooling circuit upstream of the heat load, a velocity of the flow of the cooling fluid creating a pressure drop across the orifice;

providing a second velocity fuse or a valve disposed in the cooling circuit downstream of the heat load;

dynamically actuating at least one of the first velocity fuse or the second velocity fuse to interrupt the flow of the cooling fluid through the heat load via the cooling circuit if a velocity of the cooling fluid exceeds a respective cooling fluid velocity setting of the first velocity fuse or the second velocity fuse, or both the first velocity fuse and the second velocity fuse; and triggering the second velocity fuse to interrupt the flow of the cooling fluid upon actuation of the first velocity fuse or triggering the first velocity fuse to interrupt the flow of the cooling fluid upon actuation of the second velocity fuse.

2. The method of claim 1, further comprising closing the valve when the flow of the cooling fluid through the valve reverses direction and flows upstream towards the heat load.

3. The method of claim 1, further comprising triggering an indicator when the first velocity fuse or the second velocity fuse actuates, the indicator alerting an operator to the actuation of the first velocity fuse or the second velocity fuse.

4. The method of claim 1, further comprising closing the valve or turning off the heat load in response to at least one of the first velocity fuse or the second velocity fuse interrupting the flow of the cooling fluid.

5. A cooling system comprising:

a first heat exchanger;

a second heat exchanger in parallel with the first heat exchanger;

a cooling circuit connecting a heat load to the heat exchanger, a flow of cooling fluid channeled to flow through the heat load by the cooling circuit;

a first velocity fuse disposed in the cooling circuit upstream of the heat exchanger;

a second velocity fuse or a valve disposed in the cooling circuit downstream of the heat exchanger and upstream of the heat load;

a third velocity fuse disposed in the cooling circuit upstream of the second heat exchanger; and a fourth velocity fuse disposed in the cooling circuit downstream of the second heat exchanger, wherein the heat exchanger is dynamically isolated from the cooling circuit by the first velocity fuse and the second velocity fuse or by the first velocity fuse and the valve in response to a velocity of the flow of cooling fluid to or from the heat exchanger exceeding a respective velocity setting of the first velocity fuse or the second velocity fuse.

6. The cooling system of claim 5, wherein the orientation of the second velocity fuse in the cooling circuit is the reverse of the orientation of the first velocity fuse in the cooling circuit.

7. The cooling system of claim 5, wherein the second velocity fuse or the valve interrupts a reverse flow of cooling fluid toward the heat exchanger from the heat load.

8. A cooling system comprising:

a heat exchanger;

a cooling circuit connecting a heat load to the heat exchanger, a flow of cooling fluid channeled to flow through the heat load by the cooling circuit;

a first velocity fuse disposed in the cooling circuit upstream of the heat load; and a second velocity fuse or a valve disposed in the cooling circuit downstream of the heat load, wherein the heat load is dynamically isolated from the cooling circuit by the first velocity fuse and the second velocity fuse or by the first velocity fuse and the valve in response to a velocity of the flow of cooling fluid to or from the heat load exceeding a respective velocity setting of the first velocity fuse or the second velocity fuse.

9. The cooling system of claim 1, wherein the first velocity fuse is connected to the second velocity fuse via a velocity fuse connector, wherein the velocity fuse connector actuates the second velocity fuse in response to actuation of the first velocity fuse or the velocity fuse connector actuates the first velocity fuse in response to actuation of the second velocity fuse.

10. The cooling system of claim 1, wherein the heat load is a first heat load, the cooling system further comprising a second heat load in series with the first heat load, wherein the first velocity fuse is upstream of the first heat load and the second velocity fuse or the valve is downstream of the second heat load.

11. The cooling system of claim 1, further comprising an accumulator upstream of the heat load and the first velocity fuse, wherein the accumulator absorbs an increase in pressure in the cooling system from actuation of at least one of the first velocity fuse or the second velocity fuse.

12. The cooling system of claim 1, wherein the velocity setting of the first velocity fuse is higher than a velocity setting of a third velocity fuse, wherein the third velocity fuse is positioned downstream of the first velocity fuse.

13. The cooling system of claim 1, wherein the first velocity fuse is electrically connected to a controller or indicator via an electrical circuit, wherein actuation of the first velocity fuse generates an actuation signal with the electrical circuit.

14. The cooling system of claim 1, wherein the valve is a first valve, the cooling system further comprising a third velocity fuse upstream of the heat exchanger and a fourth velocity fuse or a second valve downstream of the heat exchanger.

15. The cooling system of claim 14, wherein the heat exchanger is a first heat exchanger, the cooling system further comprising a second heat exchanger, wherein the first heat exchanger and the second heat exchanger are in parallel, and wherein a fifth velocity fuse is upstream of the second heat exchanger and a sixth velocity fuse or a third valve is downstream of the second heat exchanger.

16. The cooling system of claim 14, wherein the fourth velocity fuse or the second valve interrupts a reverse flow of cooling fluid, wherein the reverse flow of cooling fluid flows upstream to the heat exchanger from the heat load.

17. The cooling system of claim 1, wherein the heat load is a first heat load, the cooling system further comprising a second heat load in parallel with the first heat load, wherein a third velocity fuse is upstream of the second heat load and a fourth velocity fuse is downstream of the second heat load.

18. The cooling system of claim 17, wherein a fifth velocity fuse is upstream of the first heat load, the second heat load, the first velocity fuse, and the third velocity fuse.

19. The cooling system of claim 18, wherein a velocity setting of the fifth velocity fuse is higher than the velocity setting of the first velocity fuse and a velocity setting of the third velocity fuse.

* * * * *